United States Patent [19]

Lantz

[11] 4,336,635

[45] Jun. 29, 1982

[54] BED SHEET OR THE LIKE SECURING MEANS

[76] Inventor: Rose M. Lantz, 170 Sylvia St., Arlington, Mass. 02174

[21] Appl. No.: 29,747

[22] Filed: Apr. 13, 1979

[51] Int. Cl.[3] ..... A47C 21/02; A47G 9/04

[52] U.S. Cl. ..... 24/72.5; 5/498

[58] Field of Search ..... 24/72.5; D6/292; 5/460, 5/494, 496, 498

[56] References Cited

U.S. PATENT DOCUMENTS

| | | | |
|---|---|---|---|
| 368,647 | 8/1887 | Bunker | 5/498 |
| 1,083,493 | 1/1914 | Irwin | 24/72.5 |
| 1,393,137 | 10/1921 | Keene | 24/72.5 |
| 1,659,519 | 2/1928 | Dilatush | 24/72.5 |

FOREIGN PATENT DOCUMENTS

| | | | |
|---|---|---|---|
| 727270 | 3/1955 | United Kingdom | 5/498 |

*Primary Examiner*—Alexander Grosz

*Attorney, Agent, or Firm*—Herbert L. Gatewood

[57] ABSTRACT

Means for securely keeping bedding such as a bed sheet in contact with an underlying mattress are provided which can be used to keep the corners of the sheet better tucked underneath the corners of a mattress and, if desired, the side edges of the sheet also tucked under the mattress. Thus, the invention not only prevents bedding from undesirably being pulled out from underneath the mattress while one is sleeping but also facilitates making a bed.

8 Claims, 4 Drawing Figures

BED SHEET OR THE LIKE SECURING MEANS

BACKGROUND OF THE INVENTION (1) Field of the Invention

This invention relates to a bed sheet securing means, in particular a means for securely keeping mattress covers, bottom sheets, top sheets, blankets, or other bedding in contact with an underlying mattress.

(2) Description of the Prior Art

When making a bed one, in general, secures the bedding, i.e., the bottom sheet on the mattress by tucking the ends and sides of the sheet under the respective ends and sides of the mattress, thereby sandwiching the perimeter of the sheet between the box springs or other mattress support, and mattress. Thus, the bottom sheet is secured in tightly close association with the top planar surface of the mattress. Other bedding, e.g., the top sheet and blankets are then placed, in turn, on the mattress. In general, only the bottom end of the top sheet, etc., is tucked underneath the mattress, the side edges being left to hang loosely. However, in some cases, e.g., where the person is ill or is a small child, the side edges of the top sheet and blanket are also tucked under the mattress. This provides not only a sense of security to the person which contributes to a restful sleep, but also helps to keep him or her warm, particularly during the night when indoor temperatures are lowered.

During sleep, a person repeatedly changes position, shifting and turning from one side to the other. This movement by the sleeping person sometimes causes the bedding perimeter to pull out from between the mattress and box springs with the result that the bedding becomes loosened and removed from its prior rather tight-fitting association with the mattress. The sleeping person, particularly where the top sheet is tucked along the edges, as well as along the bottom end, becomes less tightly covered, or becomes at least partly uncovered. The bottom end of the top sheet, etc., may be pulled out from underneath the mattress, not only uncovering the sleeper resulting in his or her becoming chilled and uncomfortable, but also resulting in extra work in next making the bed.

The inconvenience of undesirably loosened bedclothes is also suffered by those who must re-make the make the bed each morning. Many man-hours are spent, not only in homes, but also in institutions, e.g., hotels, motels, and hospitals, where numerous beds must be made each day. The bed-making task is particularly cumbersome to the aged or handicapped and to those who suffer from back ailments or diseases of the joints such as arthritis.

One rather recent convenience in the bed-making process is the fitted or contoured sheet. This results in a relatively tightly fitting bottom sheet which is secured, in general, to the mattress at its four corners by contoured, elastic corners. The ends and sides of the contoured sheet are essentially coextensive with the ends and are sides of the mattress and pulled under the bottom edges of the mattress. With this construction the bottom sheet need not be re-secured each day to the mattress.

The fitted or contoured sheet, however, is sized to fit a particular sized mattress. Accordingly, the anchoring function of the elastic corners of the fitted or contoured sheet is lost when the sheet is used with a mattress of smaller size. The contoured sheet can not be used at all with a mattress of much larger size. Where contoured sheets have shrunk with repeated washing, it is even sometimes very difficult to cover the mattress if such can be done at all.

Another problem with contoured sheets, particularly involving institutional usage, results from the fact that contoured sheets do not iron flat for storage. Thus, more space is required to store the same number of contoured or fitted sheets, than in the case of the so-called flat sheets. Where different sized mattresses are used in institutions, the contoured sheets of different size must also be maintained separately, for efficient bed-making operation.

Even where a bottom contoured sheet is used, the top sheet is generally a flat sheet, and movement of the sleeper during sleep results in the bottom end of the top sheet and blanket being undesirably pulled out from between the mattress and box spring. Thus, the bottom end of the top sheet must be tucked under the end of the mattress each day, in making the bed. This generally requires not only considerable effort on the part of some, e.g., the aged and infirm may have difficulty in raising the corner of a heavy mattress, but also requires some extra time in making each bed, each day. The savings of a few minutes making each bed can be of considerable benefit to an institution, e.g., hospitals, motels, and hotels, where each day numerous beds must be made, but not always completely changed.

Moreover, bed-making is particularly more difficult in some case than in others, for example, when the one-sided bed may be against a wall requiring the bed itself to be moved to tuck the bedding under the mattress, and in making bunk-beds.

SUMMARY OF THE INVENTION

There is provided in accordance with my invention a bed sheet securing means which may be provided separately for later attachment to a box spring or other mattress support or to a bedstead, or the box spring or mattress can be manufactured with the bed sheet securing means in combination with it, for securing and maintaining bedding in tight association with an underlying mattress.

In its more basic aspects, the invention comprises means for securing and maintaining bedding in more permanent contact with, and tucked under, an underlying mattress, at the corners and along the bottom and top ends, and side edges. The securing means, in general, comprises a planar body member for association with the planar upper surface of a box spring or other support means for a mattress, and means for fastening the body member to the box springs in the desired association.

The invention in a more particular construction is a means for securing a bed sheet or the like on an underlying mattress, particularly at the corners, which comprises an elongated, planar, body member, and means dependent from each end of the body member for fastening the body member to a mattress support having a planar upper surface in such a fashion as to place the planar elongated body member in close association with the planar upper surface of the mattress support, whereby the bed sheet or the like can be tucked into the space between the mattress support and securing means.

Quite advantageously, the means for securing a bed sheet or the like on the underlying mattress, in accordance with the invention, not only facilitates bed-making, but also provides somewhat greater comfort, security, and restful sleep to some.

As the securing means of the invention better maintains the bed sheet tucked between the mattress and mattress support means, it reduces time and effort needed in re-making a bed, day-to-day.

BRIEF DESCRIPTION OF THE DRAWING

The invention will be better understood hereinafter by reference to the drawing, while reading the specification, in which.

DETAILED DESCRIPTION OF THE INVENTION AND THE PREFERRED EMBODIMENTS

Figure 1:
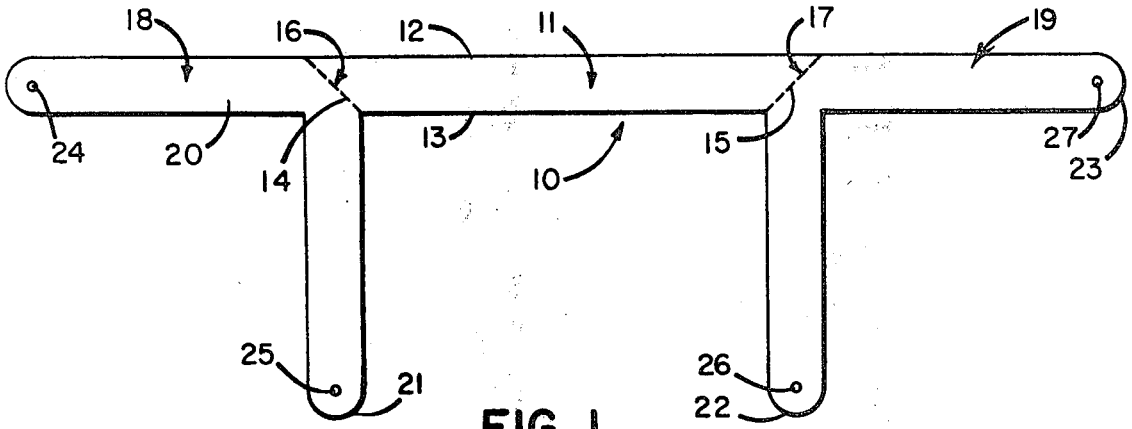
FIG. 1 is a top plan view of one embodiment of the bed sheet securing means according to the invention.

Turning now to the drawing there is disclosed in FIG. 1 thereof a means 10 for securing and maintaining bedding, such as a bed sheet, in desired association with an underlying mattress on a bed. As shown in the drawing, securing means 10 comprises an elongated, planar, centrally disposed body member 11, defined by parallel longitudinal first and second sides 12, 13, and first and second ends 14, 15. Longitudinal edge or side 13, as shown in the drawing, is somewhat shorter than edge or side 12, whereby ends 14 and 15 angle inwardly toward one another and at equal angles 16, 17, e.g., at 45°, with respect to longitudinal edge or side 12. The reason for this will be made plain later.

At the ends of the elongated body member 11, depend bifurcated or forked members 18, 19, for fastening the elongated planar body member in the desired association with the top planar surface of the mattress support, as later disclosed. Bifurcated members 18, 19 each comprise two forks or branches 20, 21 and 22, 23. The bifurcated branches at each end intersect with one another at an angle of 90° and are all of the same length.

In the preferred embodiment of the invention, bifurcated ends 18, 19 are integral with elongated planar body member 11; however, these ends can be, if desired, manufactured as separate components and later attached to body member 11 by suitable means. The main consideration is that in use the bifurcated ends will depend from ends 14, 15 and be disposed in a vertical plane perpendicular to the horizontal plane of elongated body member 11. Thus, bifurcated ends 18, 19 can be connected to body member 11 by means of separate hinges which permit pivotal movement of these bifurcated ends with respect to the body member, or the bifurcated ends 18, 19 can be secured by adhesive or other means to the ends 14, 15 of body member 11 by conventional 90° angle means, in which case the bifurcated ends will be in fixed relation to the body member 11.

Figure 4:
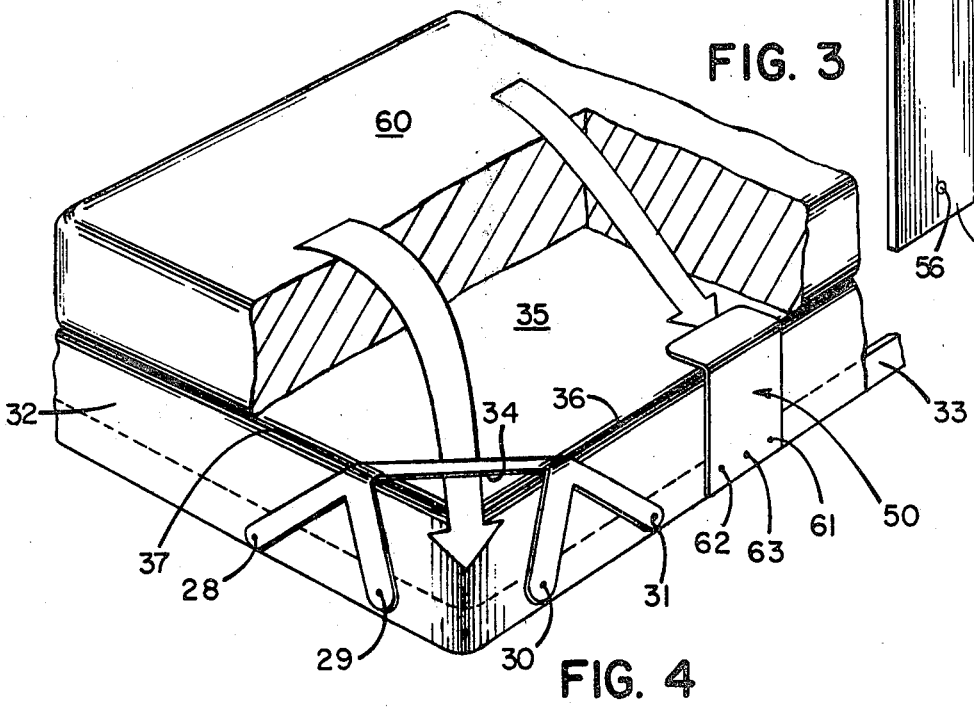
FIG. 4 is a perspective view showing the bed sheet securing means disclosed in FIGS. 1 and 3 in use in combination with a box spring shown in partial perspective, showing a mattress supported by the box springs in section.

As shown in the drawing, each branch of the bifurcated end is provided with an opening 24, 25, 26, and 27, for insertion of a suitable fastening means, such as conventional threaded screws 28, 29, 30, 31, for fastening securing means 10 at the corner of a conventional box springs 32 (FIG. 4). The screws 28, 29, 30, 31 are screwed into the wooden base frame 33 of the box springs.

Securing means 10 is so located on box springs 32 that the underneath planar side 34 of the elongated body member 11 of the securing means 10 is associated in loose contact with the upper planar surface or cover 35 of the box springs. Elongated body member 11 extends across the corner of box spring 32 from upper side edge 36 of the box spring 32 to upper end edge 37, the same distance from the corner. Thus, ends 14, 15 of elongated body member 11 coincide with edges 36, 37, as shown.

It will be appreciated by those skilled in the art that the securing means 10 can be longer or shorter, as desired; however, in general, a satisfactory securing means will be provided where the body member is about 16" in length and the ends are each about 10" in length. The width of the body member and the components of the bifurcated ends can be about 1".

Securing means 10 can be manufactured of various materials, e.g., various plastic materials such as polyethylene, polypropylene, vinyl chloride, nylon, etc., metal, elastomeric materials such as natural or synthetic rubbers, plastic or rubbery coated metal strapping material, or even wood. The most desired material of construction is a plastic composition such as polypropylene. The securing means of the invention can be readily, and economically molded from this plastic material and provided of various colors, as desired.

Using a plastic material such as polypropylene permits the elongated body member and bifurcated ends to be provided as a single, unitary construction. In this case, the securing means will be generally molded in a flat configuration, as shown in FIG. 1 of the drawing, the ends 14, 15 defining the ends of the body member 11, being provided in the molding operation according to usual techniques for hinging the bifurcated members 18, 19 to the body member. More than one hinge line can be provided at each end of the body member 11, if desired, to account for different possible thicknesses of box springs, or other mattress support means, as well as different locations of the securing means 10 from the corner of a mattress support.

Figure 2:
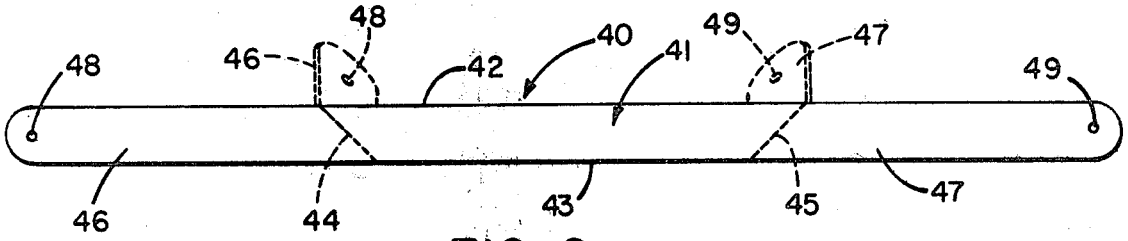
FIG. 2 is a top plan view of another embodiment of a bed sheet securing means.

In FIG. 2 of the drawing there is shown an alternative securing means 40 in accordance with the invention, of even somewhat simpler construction. The centrally disposed planar body member 41 is of the same configuration as that of securing means 10 and is defined by parallel first and second sides 42, 43, and first and second ends 44, 45. Connected to these ends, however, are simple, elongated planar means 46, 47 which can be pivoted downwardly from ends 44, 45, respectively, for fastening the body member 41 in the desired association with the upper surface of a box springs or other mattress support.

The distal ends of the means 46, 47 for fastening down elongated body member 41 are provided with openings 48, 49 for insertion of conventional fastening means such as threaded screws, nails, or the like. It will be appreciated that openings 48, 49 need not be circular, as shown, but can be of other configuration, or even slots can be provided. The distal ends means 46, 47 can even be fastened to the box springs by adhesive means or, in some cases, even by heavy duty staples. The actual fastening means is of no particular consequence.

As shown in the drawing, the terminal ends of the means for fastening 46, 47 are desirably rounded, whether bifurcated as shown in FIG. 1, or not, as shown in FIG. 2 of the drawing. This is particularly desirable in case the material or construction is metal or some other rather inflexible material, so as not to provide any sharp corners.

As earlier disclosed, the desired manner of manufacture of a securing means in accordance with the invention is by conventional molding techniques. In this way, the securing means can be manufactured flat as shown in FIGS. 1 and 2. A securing means can be manufactured of unitary construction, hinge lines being provided during the molding operation. Thus, the securing means can be manufactured simply and at relatively little cost. However, in this manner of manufacture, the ends 14, 15 of the elongated body member 11 must be delimited at angles, as shown in FIGS. 1 and 2, to enable the means for fastening the body member to the mattress support, to be pivoted perpendicularly downwardly, for fastening to the mattress support. When this occurs, the means for fastening will be at acute angles to the edges 36, 37 of the mattress support, as shown in FIG. 4 of the drawing.

However, the bed sheet securing means according to the invention need not be of flexible material, or molded in a flat configuration as shown in FIGS. 1 and 2 of the drawing. The securing means can be, for example, molded of a relatively rigid plastic material such as nylon and in such a configuration that the means for fastening the planar body member in association with the planar surface of the mattress support is fixedly dependent perpendicularly from the ends of the body member. Either the bifurcated means can be provided or the single means, as disclosed in FIG. 2. This manner of manufacture permits the means for fastening the elongated body member to depend not only perpendicularly downwardly with respect to the body member, but the center line of the means for fastening to be vertically disposed, as well.

The securing means of the invention as shown in FIGS. 1 and 2 need not be of flat planar configuration, although this construction is most preferred. The elongated body member and means for fastening the body member connected at its ends to the mattress support can be of cylindrical configuration, e.g., like a rope. The centrally disposed body member can be of planar configuration and the means connected at its ends for fastening the body member to a mattress support can be of elongated cylindrical configuration, e.g., of elastomeric material, flattened only at the free ends in which are provided openings for insertion of fastening means.

Figure 3:
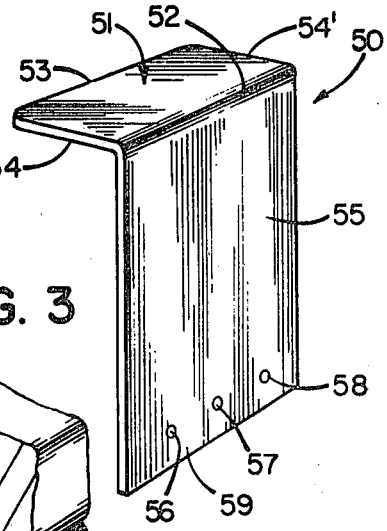
FIG. 3 is a perspective view of still another embodiment of a bed sheet securing means in accordance with the invention.

Referring now to FIG. 3 of the drawing, shown therein is a securing means 50 in accordance with the invention of somewhat different configuration for maintaining the edges or ends of a bed sheet on an underlying mattress. In this case, securing means 50 comprises a planar body member 51 defined by first and second parallel sides 52, 53, and first and second ends 54, 54'. Depending perpendicularly downwardly from side 52 is elongated means 55 for fastening the body member 51 to a mattress support. As shown in the drawing, the width of means 55 is coextensive with the length of body member 51; however, this need not be the case. Means 55 can, instead, for example, comprise two spaced apart means depending downwardly from side 52. The main requirement is that this means be connected to and depend downwardly from one side of the body member so that the body member will be provided in the desired relationship to the mattress support. Securing means 50 can be manufactured of various materials as earlier mentioned in the case of the other securing means. However, in contrast, it will be of relatively rigid, inflexible, construction and the orientation of the body member with respect to the means for fastening it to the mattress support will be fixed.

The means 55 for fastening the body member 51 of securing means 50 to a mattress support is provided with a plurality of spaced apart openings 56, 57, 58 adjacent its bottom edge 59 for insertion of suitable conventional fastening means such as screws or nails. While these openings are seen from the drawing to be equally spaced from edge 59, this need not be the case, of course. Nevertheless, the openings must be so located and the length of means 55 such that the bottom surface of planar body member 51 is positioned, on fastening of the securing means to the mattress support, closely adjacent the top surface of the mattress support. Thus, sufficient room will be allowed for tucking a bed sheet or the like between the bottom surface of the body member and the top surface of the mattress support means, yet provide resistance to the bed sheet in being pulled out. In some cases, it may be desirable to have the securing means so positioned with respect to the top surface of the mattress support means that the mattress support means is slightly compressed, making a very tight fit of the bed sheet. To provide a variable spacing between the securing means and box springs surface, openings 56, 57, and 58 can be vertical slots and the fastening means can be of a wing nut variety. In a similar manner, the means for fastening securing means 10 can also be made adjustable so that a tight or loose fit can be provided between the underneath surface 34 of elongated body member 11 and the top surface of the box springs.

The use of the securing means of the invention is disclosed in FIG. 4 of the drawing. As shown therein, the bifurcated members 18, 19 for fastening body member 11 of securing means 10 in association with the planar top surface 15 of box springs 32 have been fastened to the wooden frame 33, by means of conventional screws 28, 29, 30, and 31. This provides the underneath planar side 34 of the body member 11 in close association with the top of the mattress support. Securing means of like construction are provided in similar fashion at each of the four corners of the box springs 32. The bottom bed sheet, for example, is placed on the mattress 60 in usual fashion and the corners thereof are tucked under the securing means 10, as shown by the arrow in the drawing. This conforms the corner of the bed sheet to the corner of the mattress, holding the bed sheet securely in place. The perimeter of the bed sheet between the corners is then tucked between the bottom of the mattress and top of the box springs in usual fashion. The corner of the bed sheet can then be pulled as tightly as desired.

The weight of the mattress pressing against the securing means 10 and the tucked corner of the bed sheet inhibits the bed sheet from being pulled out from under the securing means, always providing a corner of the bed sheet readily available for use again in facilitating making the bed and pulling the bed sheet down smooth on the mattress. As the corners of the bed sheet are kept tucked under the mattress, the bed sheet between the corners also tends to stay tucked under. Thus, when a top sheet and blanket are next secured at the foot of the bed, the bed clothes tend to stay tucked under the mattress during sleep, facilitating next making of the bed and requiring less effort.

In some cases, where it is desired to secure the sides of a bed sheet and blanket, securing means 50 can also be used, in addition to securing means 10. Thus, securing means 50 is fastened to box springs 32 by means of conventional screws 61, 62 and 63. This will provide the underneath side of body member 51 in close association with the planar top surface 35 of box springs 32. The bed sheet and blanket, for example, are then tucked between the securing means 50 and top surface of the box springs, as shown by the arrow in the drawing, and pulled down at that point along the edge of the box springs. Thus, a small child can be made to feel secure in bed, after having been "tucked in", and prevented from getting chilled during the night, as the bed covers will stay better tucked under the mattress.

Although not shown in the drawing, it will be appreciated that the legs of the bifurcated ends can intersect with one another at an angle other than 90° and need not be of the same length. Also, one bifurcated end can be longer than the other, in which event the hinge may not be located equidistantly from the corner and may not be on a 45° angle, as earlier described. Neither is it necessary that both legs of the bifurcated ends depend from the end of the centrally disposed body member, one leg can be a continuance of the body member as seen from FIG. 1 of the drawing and the other leg depend from it at some point between the hinge and the terminal end.

It will be understood that various changes, and modifications can be made in the securing means according to the invention without departing from the spirit and scope thereof, the features of which are set forth in the accompanying claims.

I claim:

1. Means for securing and maintaining a bed sheet or the like on a mattress of a bed supported on a platform like support means having a planar upper surface, said securing means comprising in combination a centrally disposed, elongated body member for association with the planar upper surface of said support means and defined by first and second sides and first and second ends, and bifurcated members comprising first and second branches pivotally connected to each said first and second ends of the body member capable of when pivoted depending perpendicularly downwardly of fastening said body member in close association with said planar upper surface whereby the said bed sheet or the like can be secured between said securing means and the said support means.

2. Means for securing and maintaining a bed sheet or the like on a mattress of a bed supported on a platform like support means having a planar upper surface according to claim 1 wherein said first and second branches are of equal length and on being pivoted perpendicularly downwardly the said first and second branches of the bifurcated means for fastening are at 45° angles with respect to the horizontal.

3. Means for securing and maintaining a bed sheet or the like on a mattress of a bed supported on a platform like support means having a planar upper surface according to claim 1 wherein the securing means is of a relatively flexible plastic material.

4. Means for securing and maintaining a bed sheet or the like on a mattress of a bed supported on a platform like support means having a planar upper surface according to claim 1 wherein the securing means is of unitary planar construction and the centrally disposed body member is delimited at the first and second ends by hinge lines which angle inwardly toward one another at equal angles from said first side to the said second side.

5. Means for securing and maintaining a bed sheet or the like on a mattress of a bed supported on a platform like support means having a planar upper surface according to claim 4 wherein the securing means is of polypropylene.

6. Means for securing and maintaining a bed sheet or the like on a mattress of a bed supported on a platform like support means having a planar upper surface according to claim 15 wherein openings are provided in the distal ends of the branches of the bifurcated members for insertion of means for fastening the securing means to the platform like support means.

7. Means for securing and maintaining a bed sheet or the like on a mattress of a bed supported on a platform like support means having a planar upper surface according to claim 6 wherein the openings are elongated in the direction of the length of the branches whereby the closeness of the securing means to the platform like support means can be adjusted.

8. Means for securing and maintaining a bed sheet or the like on a mattress of a bed supported on a platform like support means having a planar upper surface, said securing means being of relatively inflexible material and comprising in combination a centrally disposed, elongated body member for association with the planar upper surface of said support means and defined by first and second sides and first and second ends, and bifurcated members comprising first and second branches fixedly connected to each said first and second ends of the body member extending perpendicularly downwardly for fastening said body member in close association with said planar upper surface whereby the said bed sheet or the like can be secured between said securing means and the said support means.

* * * * *